US008017091B2

(12) United States Patent
Kayagil et al.

(10) Patent No.: US 8,017,091 B2
(45) Date of Patent: Sep. 13, 2011

(54) BEADWHACKER

(75) Inventors: Turan A. Kayagil, Arlington, VA (US); Julie A. Richardson, Jackson, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1050 days.

(21) Appl. No.: 11/601,654

(22) Filed: Nov. 20, 2006

(65) Prior Publication Data

US 2008/0118406 A1 May 22, 2008

(51) Int. Cl.
*B01L 3/00* (2006.01)

(52) U.S. Cl. ..... 422/500; 422/527; 422/533; 422/560; 422/561; 366/108; 366/109; 366/110; 366/114; 366/197; 366/200; 366/208; 366/209; 366/213; 366/214; 366/218; 366/219; 366/220; 141/71; 141/72; 141/73; 141/74; 141/75; 141/76; 141/77; 141/78; 141/79; 141/80

(58) Field of Classification Search ..... 422/100, 422/500, 527, 533, 560, 561; 366/108–110, 366/114, 197, 200, 208–209, 213–214, 218–220; 141/71–80

See application file for complete search history.

(56) References Cited

U.S. PATENT DOCUMENTS

| | | | | |
|---|---|---|---|---|
| 3,935,884 | A * | 2/1976 | Hazelton | 141/80 |
| 5,114,680 | A * | 5/1992 | Obermiller et al. | 422/104 |
| 2003/0127396 | A1 * | 7/2003 | Siddiqi | 210/695 |

* cited by examiner

*Primary Examiner* — Michael A Marcheschi
*Assistant Examiner* — Jameson Q Ma
(74) *Attorney, Agent, or Firm* — Amy L. Ressing; Stephen T. Hunnius

(57) ABSTRACT

A device consisting of a low-RPM motor wherein the motor spins a flat disk, a peg is attached to the disk, a stationary spring armature wherein the peg can activate the stationary spring armature as the disk rotates, and a tube containing beads in a fluid positioned in a top plate wherein the spring armature can contact the tube. This device can further include a soft closed-cell foam top mounted on the top plate wherein the tube is inserted and maintained by the foam in such a way as to allow for slight motion of the tube induced by the contact by the spring armature.

10 Claims, 9 Drawing Sheets

| Mixing Method | Static | Orbital Shaker | Magnetic Stirrer | Bead Whacker |
|---|---|---|---|---|
| Trial 1 | 12 | 11 | 15 | 28 |
| Trial 2 | 6 | 8 | 13 | 22 |
| Trial 3 | 9 | 12 | 12 | 26 |
| Trial 4 | 10 | 10 | 15 | 30 |
| Mean ± StDev | 9 ± 3 | 10 ± 2 | 14 ± 2 | 27 ± 3 |

Figure 9

BEADWHACKER

BACKGROUND

The present invention relates to automated devices for maintaining an even dispersion of solid phase extraction beads in small volume tubes.

Beads are used in an ever increasing number of applications including separation, detection, and nanotechnology research. For biological assays or for target concentration, a capture molecule such as, but not limited to, an antibody or oligonucleotide is immobilized on the beads, and the modified beads are used to capture the target from a sample fluid. Effective dispersion of the beads is important both during the immobilization procedure and during the target capture reaction. The beads are usually a polymer, metal colloid, glass, or magnetic material.

Solid-phase extraction has become popular as a laboratory tool for bio-separation and target pre-concentration. Beads packed into columns are used for initial sample cleanup prior to analysis using gas chromatography and GC-MS, HPLC, and LC-MS systems. In addition to bench-top applications, solid phase extraction columns have been incorporated into microfluidics-format portable devices as well as larger, automated, high throughput systems for bio-separations in clinical chemistry, pharmaceutical bio-analysis, forensics, drug discovery, and analytical biochemistry.

Recently, single tube techniques based on free-standing suspensions of beads have been introduced; these are especially useful for quickly and efficiently capturing specific or random nucleic acid fragments in low volume tubes. Bead-based technologies of this type replace more labor intensive precipitation reactions and eliminate the use of phenols and other toxic chemicals.

Although the introduction of free-standing bead suspensions has produced a significant decrease in the time and effort required for solid phase extractions, the suggested procedures are still far from automated. It is desirable to eliminate as many manual steps as possible in order to minimize the time and labor, to enhance reproducibility, and to integrate the processes into automated sensors and reactors.

Several attributes are desirable in this type of automated device. First, it can be able to maintain an even dispersion of beads in solution, in order to maximize exposure of the bead surface area to components in solution. Second, it can continuously mix the beads for extended time periods in order to avoid gradients in solution, while avoiding the formation of droplets or bubbles in solution. Third, the device can have the capability of performing this agitation at a wide variety of temperatures. Fourth, the device can operate in a manner that provides reproducible results. Fifth, the device can be able to handle multiple samples simultaneously. Finally, the device can incorporate a mechanism for pelleting the beads (if possible), so that the supernatant can be removed from the reaction chamber.

During both attachment of the capture molecules and the use of the beads to bind the target(s), even dispersion of the beads is desirable so that there is maximum exposure of the bead surface to the solution. The formation of bubbles within the liquid or droplets on the inside walls of the tube is undesirable because it either causes decreased immobilization of the capture molecule or results in decreased exposure of the target to the capture molecule on the beads.

The current method of achieving even bead dispersion is to manually hold the tube in one hand and tap gently on the outside of the tube with the tip of the fingers of the other hand, or to place the tube in a vortex mixer. This method is limiting in several ways: First, the method requires a person to be present to actively tap the tube or hold it in a vortex mixer. This means that, for dispersion to be maintained, that person must continuously tap the tube. Usually, instead of doing this for extended periods of time, the person will return during the course of an experiment to disperse the beads once every few minutes. The result is that the beads do not remain uniformly dispersed throughout the experiment, but rather settle and are re-dispersed multiple times. Second, the method only allows one PCR tube at a time to undergo bead dispersion, even though multiple tubes may be needed for an experiment. Third, the method may cause the formation of unwanted bubbles or droplets. Fourth, the method is inconsistent between implementations. This means that results of an experiment that relies on even bead dispersion may be affected by the different degrees of dispersion delivered to different samples.

Another method of keeping beads dispersed is to agitate the tube containing the beads on some sort of electrical shaking device. This method eliminates the need for a person to continuously be present, but the method is limited in that it causes the formation of droplets and air bubbles which may interfere with binding. When agitation is finished, the tube containing the beads may need to be centrifuged to cause any droplets to settle. This requires a power source for the centrifuge, and it requires a separate piece of equipment (the centrifuge). Also, for single tubes, counterbalancing of the centrifuge might be required.

Using magnetic beads provides for simple isolation of the beads using a magnet whereas the nonmagnetic beads are usually captured by gravity sedimentation, centrifugation, or filtration. Once the beads are concentrated into a tightly packed pellet, the remaining supernatant may be removed or saved, depending on the objective of the operation. The nonmagnetic beads may take longer to separate from the sample fluids and the operations may be technically time consuming or inefficient, especially for high viscosity samples or very small beads.

A current method for settling magnetic beads is to hold the tube containing the beads upright over a magnet. This method is limited because it requires the presence of a separate piece of equipment (a strong magnet) and because the operator may be required to hold the tube for extended periods until the beads settle (e.g. because conical tubes will not sit upright and the bottom of the tube must be in close proximity to the magnet for the desired effect).

Another method of separating magnetic beads involves the use of a magnetic stand specifically designed for the purpose which usually places the magnet alongside the tube to produce a shorter path length. The beads are held on the side of the tube while the operator withdraws the fluid. This method is limited in that it requires a separate piece of equipment (the magnetic stand).

BRIEF DESCRIPTION OF THE DRAWINGS

These and other objects, features, and advantages of the invention, as well as the invention itself, will become better understood by reference to the following detailed description, appended claims, and accompanying drawings where:

FIG. 9 shows a table of percentage of immobilized DNA after 6 h of binding with various mixing methods.

DETAILED DESCRIPTION

Figure 1:
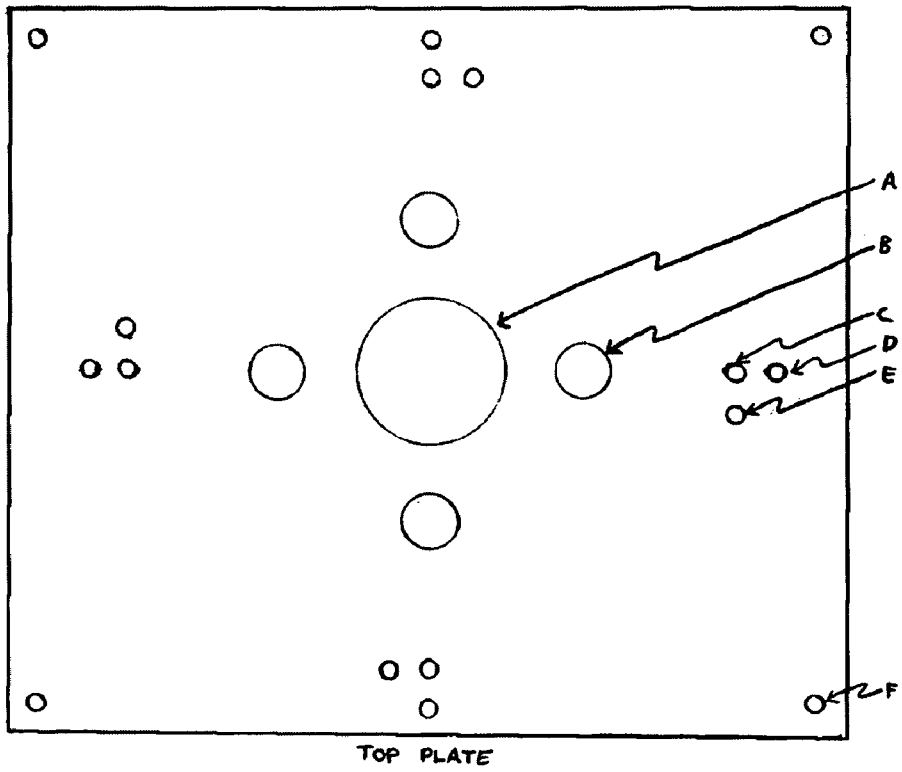
FIG. 1 shows the top plate.

The present invention concerns an automatic device for maintaining an even dispersion of solid phase extraction beads in small volume tubes. The "beadwhacker" is especially designed for use in laboratories developing interfacial chemistries or immunomagnetic separations. Aspects of the beadwhacker include automatic operation, multiple sample capability, and reproducible operation for extended periods of time.

These devices can evenly disperse small beads (sub-micron to mm in diameter), commonly magnetic or glass, in small tubes (≦1 ml), without forming bubbles or droplets, and can maintain this state of even dispersion for as long as the invention is in operation. This invention can accomplish this purpose for multiple tubes simultaneously, with a minimum operation time of <15 seconds, and an indefinite maximum operation time. A purpose of maintaining even bead dispersion within the tube can be to facilitate a reaction within the tube that is aided by the even dispersion.

Another purpose of the invention can be to incorporate into the same device that provides bead dispersion an apparatus to cause beads to settle rapidly to the bottom of the tube(s), leaving the supernatant above the tightly packed bead pellet. Specifically for magnetic beads, the invention can cause the beads to form a pellet within 15 seconds of placing a tube containing the beads into the invention, whereas settling using gravity alone would take at least several minutes and may not be as complete. Additionally, the ability to rapidly achieve a state of settled beads facilitates the quick visual diagnosis of the operation of the bead-dispersing portion of the invention, since the beads can be alternately settled and dispersed to verify correct dispersion.

The invention can consist of a primary and a secondary component. The primary component can be a rotary mechanism that gently taps the sides of multiple tubes to suspend beads in a fluid and maintain that dispersion for any required period of time. The secondary component can include a magnet for separating magnetic beads from the surrounding fluid.

The mechanism of the bead dispersion portion of the invention can be as follows. A low-RPM motor spins a flat disk mounted on the motor shaft. Pegs can be attached to the circumference of the disk and can be perpendicular to the plane of the disk. These pegs can draw and release stationary sprung armatures as the disk rotates. Each armature can tap one tube, which can hang above the armature through an oversized circular cutout in a top plate. A soft closed-cell foam top can be mounted on the top plate with a perforation in line with the circular cutout, so that the tube may be inserted through the perforation and held by the foam in such a way as to allow for slight motion of the tube induced by the tapping. Additionally, the foam top allows the tube holes machined into the plastic top to be oversized. Because the foam top can close snugly around the samples, both 0.5 and 1.5 mL tubes can be held in place in the beadwhacker without the substitution of any device parts.

The component for bead separation consists of a holder into which a tube may be inserted. At the bottom of this holder can be a magnet, such that when the tube is inserted, the bottom of the tube can be in close proximity to the magnet. The beads can settle rapidly toward the magnet, leaving the supernatant clear of beads.

A number of alternative features can be built into the prototype described herein. Motors with different speeds or variable rates can be introduced in order to alter the dispersion characteristics of the device. It can be possible to add resistive heaters or Peltier elements, along with sufficient insulation, in order to achieve desired heating and cooling of the tubes. The beadwhacker described herein can have the capability of holding four samples, however, modification for the processing of a larger number of samples can be relatively straightforward. Finally, the permanent magnet in the bead settler can be replaced with an electromagnet for automated operation. This electromagnet can be located near the tubes in the mixing position, providing bead settling without moving the tube (s) to a separate bead settling area. The beadwhacker can be designed for automatic operation, meaning that it can be loaded and then be left alone to perform agitation, similar to a standard laboratory mixer. Some of the developments listed above, as well as the incorporation of pumps and valves, can be used to make the beadwhacker into a further automated device.

In a preferred embodiment of the invention, the primary component can provide for bead dispersion as follows: a low-RPM motor spins a flat disk mounted on the motor shaft. Pegs can be attached to the circumference of the disk, perpendicular to the plane of the disk. These pegs can draw and release stationary sprung armatures as the disk rotates. Each armature can tap one small tube, which can hang above the armature through an oversized circular cutout in a top plate. A soft closed-cell foam top can be mounted on the top plate with a perforation in line with the circular cutout, so that the tube can be inserted through the perforation and held by the foam in such a way as to allow for slight motion of the tube induced by the tapping.

As an example of the secondary component that separates magnetic beads from the surrounding fluid, the invention can also include a bead separation portion. In one embodiment, this component can consist of a holder into which the small tube can be inserted. At the bottom of this holder can be a magnet, such that when the tube is inserted, the bottom of the tube can be in close proximity to the magnet.

The beadwhacker can accept multiple samples in tubes ranging in size from about 0.5 to 1.5 mL and functions in a variety of environments due to its portability. With additional tubing and pumps, and the incorporation of an electromagnet, the beadwhacker can be incorporated into a larger automated system. Furthermore a device of this type may be useful not only for the formulation and testing of bead-based separation techniques, but also in traditional chemical synthesis areas such as the surface modification of micron-sized silica, zirconia, or titania beads; for modification of polymer microspheres used as packings for classic HPLC and liquid chromatography columns; or for nanoparticle synthesis.

Although many types of bead-based chemistry can be used with this device, it can have an accessory designed for use with magnetic or paramagnetic beads. With such beads isolation of the reacted beads can be achieved rapidly with a magnet. Once these beads have been concentrated into a tightly packed pellet, the supernatant can be recovered and can be discarded or saved according to the application.

Example 1

Bead Dispersion Component

The following descriptions refer to an embodiment of this device. However, it should be noted that this specific construction is not necessary for the invention. As an example, the motor can be mounted above the rotating disk, rather than below it.

FIG. 1 shows the top plastic plate of the bead dispersion portion of the invention. This plate has screw holes (F) to attach it raised above the base. The plate features circular cutouts (B), through each of which a small tube can be inserted. The diameter of each hole (B) is slightly greater than the maximum diameter of the tube that will pass through that hole. The holes (B) can be arranged evenly around a larger center circular hole (A). For each hole (B), there can be a corresponding armature mounting hole (D). This hole (D) takes a downwards-protruding screw.

A semi-flexible armature (a trimmed cable tie can be used as the armature) is secured to this screw, underneath the top plate. The armature will serve to tap the vial in position at hole (B). Holes (C) and (E) also take downwards-protruding screws. The armature secured to the screw at (D) passes between the screws at (C) and (E), and protrudes less than halfway into the hole (A). The screw at (E) serves as a peg to prevent the armature from rotating counterclockwise around the peg at (D). The screw at (C) likewise prevents the armature from rotating clockwise around the peg at (D). Holes (C) and (D) have their centers in line with that of hole (B), such that the armature will pass under hole (B) offset slightly to the clockwise edge of hole (B) (here taking "clockwise" as defined around the circle (A)).

In order to load a tube into position at (B), the armature must therefore be manually deflected counterclockwise, by reaching through hole (A). Once a tube is loaded into position at (B), the peg at (C) will keep the armature under tension against the counterclockwise side of the tube. The position of the peg (C) can be made variable, allowing for adjustment of the tension, and thus of the strength of tapping. As constructed, the invention allows for easy replacement of the tapping armatures if they become worn: an old armature may be disconnected from peg (D), and a new armature may be connected in its place.

The top plate as shown in FIG. 1 accommodates up to four small tubes at a time, but this number can be expanded by increasing the diameter of hole (A), increasing the number of holes (B), and increasing the number of corresponding pegs (C), (D), and (E). The tapping delivered to each vial is independent of the number of vials loaded at a given time.

Figure 2:
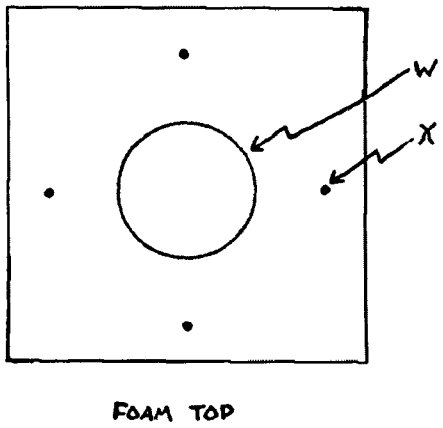
FIG. 2 shows the foam top.

Because the holes (B) can be oversized, another component can be used to hold the tubes. This component can be a soft, closed-cell foam top, shown in FIG. 2. In one example, this top is secured to the top of the top plate (FIG. 1) such that perforations (X) in the foam align with the centers of holes (B) in the top plate. The foam top features a hole (W) of equal diameter as hole (A), and these two holes align when the foam top is secured to the top plate. The hole (W) exists so as not to interfere with manual adjustment of the armatures that must be made by reaching through hole (A). Each perforation (X) can accommodate the insertion of a small tube, such that the top of the tube is approximately flush with the top of the foam, and the bottom of the tube extends through hole (B) and past the level of the armature. The foam can hold the tube in place, while at the same time (in combination with the oversized hole (B)) allows some leeway for motion of the tube in response to the tapping delivered by the armature. This induced motion of the tube simulates that provided by finger tapping, and can be important for even bead dispersion. Even though foam was used in the prototype as constructed, the component of FIG. 2 can be constructed out of any suitably flexible material, such as rubber or polydimethyl siloxane. Because the perforations (X) in the foam may be difficult to see, it can be useful to mark their location visually. Again, the foam top as shown accommodates four small tubes, but this can be expanded by increasing the diameter of hole (W), and increasing the number of perforations (X).

Figure 3:
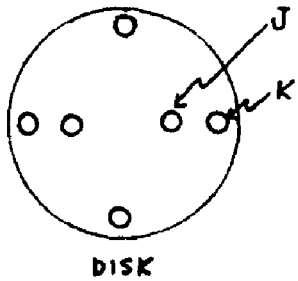
FIG. 3 shows the disk.
Figure 4:
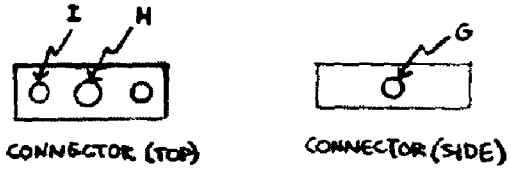
FIG. 4 shows the connector for attaching the disk to the motor shaft.

FIG. 3 shows the plastic rotating disk that actuates the tapping armatures. In this example, the top of this disk sits at a lower level than the bottoms of the small tubes inserted into the invention, and the center of the disk is aligned with the center of the hole (A) in the top plate. The disk features evenly spaced holes (K) along its circumference, each of which accepts an upwards-pointing screw. The outside diameter of the circle of screws (K) on the disk can be less than that of the inside diameter of the circle of holes (B) in the top plate. The height of each screw at (K) can be adjusted to be sufficient to reach the level of the armatures, but to be less than the height of the lower side of the top plate. The screws at (K) can be secured so as not to rotate (for example, by using shrink tubing). In this embodiment, the disk has four screws at (K). This number was chosen because the motor used rotated at 30 RPM, and a 2 Hz tapping rate was determined to be effective for providing even bead dispersion. However, by varying the number of screws at (K), the tapping rate could be varied proportionally. Additionally, by varying the diameter of the circle of screws at (K), the strength of tapping could be varied. The disk of FIG. 3 also has holes (J) for mounting the disk to a motor connector piece as shown in FIG. 4.

In this example, the plastic motor connector piece has screw holes (I) that correspond to the holes (J) in the disk. The center of the connector has a hole (H) that fits over the shaft of the motor as shown in FIG. 5.

In this example, the motor shaft (M) is flattened. The connector has a hole (G) in the center of one side. This hole goes through to the hole (H) in the connector. The hole (G) accepts a set screw that tightens down onto the flattened face of the motor shaft (M). The motor is a low-RPM, high torque motor. In this embodiment, a 12 VDC geared-down 30 RPM motor was used. However, the motor speed can be varied to proportionally vary the rate of tapping. The motor has holes (L) for mounting to the base, such that the motor shaft (M) is aligned with the center of the hole (A) in the top plate.

Figure 5:
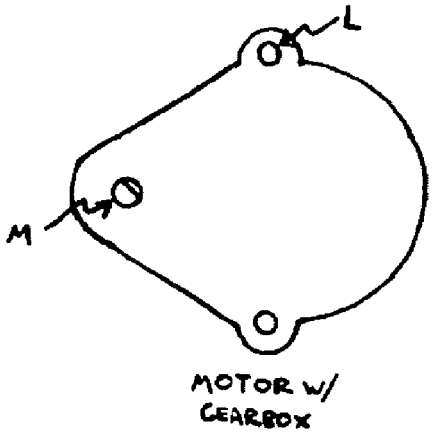
FIG. 5 shows the motor.

As shown in FIG. 5, the motor shaft rotates counterclockwise. This rotates the connector/disk assembly counterclockwise, causing the pegs at (K) to draw back the armatures so that they are under greater tension (as maintained by the pegs at (C)), and so that the armatures no longer contact the sides of the loaded tubes. As the disk continues to rotate counterclockwise, the pegs release the armatures, which spring back to their original positions, resting against the counterclockwise sides of the tubes. This provides a tapping motion which can cause the tubes to rebound slightly against the foam top. The sequence can then be repeated. This motion can provide even bead dispersion within the tubes. The sequence is illustrated as shown in FIG. 6.

Figure 6:
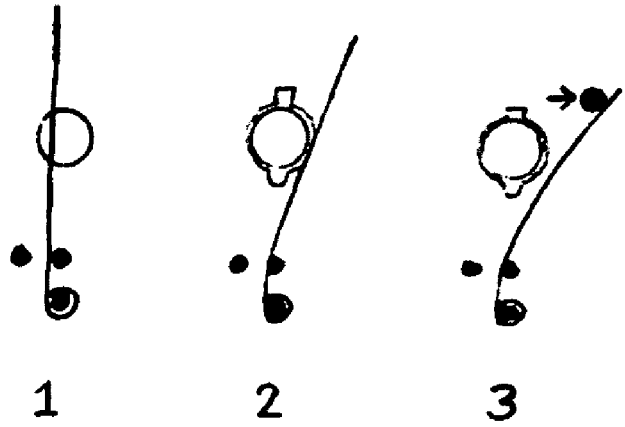
FIG. 6 shows the armature positions.

Illustration 1 of FIG. 6 shows the armature position offset to the clockwise side of hole (B) before a tube is loaded. Illustration 2 of FIG. 6 shows the armature position after a tube is loaded into position at hole (B) (foam top not shown). The armature is held under tension against the counterclockwise side of the tube by the peg at (C). As the disk rotates counterclockwise, one of the pegs at (K) draws back the armature as shown in illustration 3 of FIG. 6. As the disk continues to rotate, the peg at (K) passes the end of the armature, and the armature resumes its position in illustration 2, thereby tapping the side of the small tube. As the next peg at (K) passes, this tapping is repeated.

Figure 7:
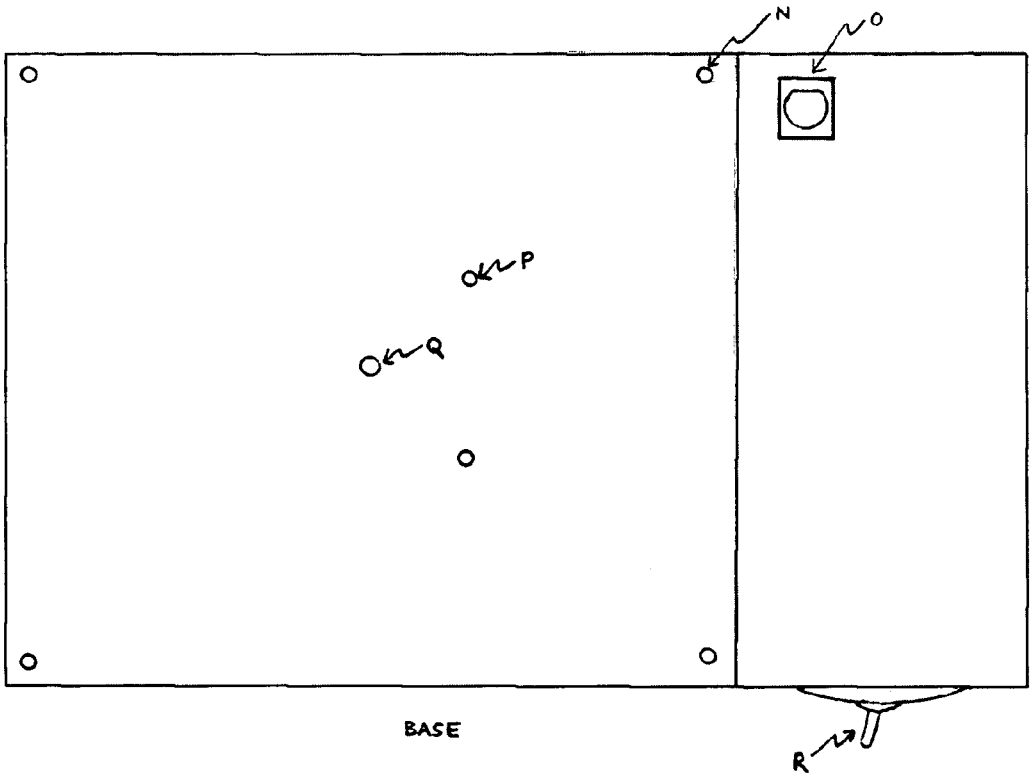
FIG. 7 shows the base.
Figure 8:
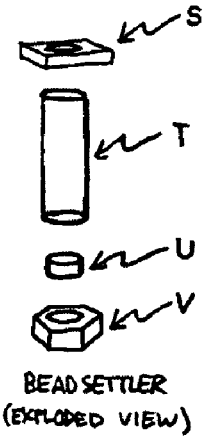
FIG. 8 shows the bead separator construction.

FIG. 7 shows the base. In this example, the motor (FIG. 5) is mounted to the raised underside of the base, such that the holes (P) in the base align with the holes (L) in the motor, and the hole (Q) in the base aligns with the motor shaft (M). The holes (P) are used to secure the motor to the base, such that the flat top of the motor rests against the flat underside of the base, and the hole (Q) allows the motor shaft (M) to pass through to the topside of the base, where the connector of FIG. 4 can be attached. The base also has holes (N) to accept long screws that pass downwards through the holes (F) in the top plate. These screws use spacers to keep the top plate raised to the appropriate level above the base. In this example, these spacers were a combination of plastic collars and nuts. The right side of the base in FIG. 7 is raised to be flush with the level of the top plate when the top plate is installed. The right side of the base houses a well (O) for the bead settling portion of the invention (FIG. 8). It also has an on/off switch (R) on its front side.

Example 2

Magnetic Bead Separation Component

FIG. 8 shows a construction of the magnetic bead separation component, as implemented in the prototype. A rare-earth button magnet (U) is placed on the bottom of the well at (O). The magnet is positioned inside a nut (V) that has approximately the same inner diameter as the magnet (U), the same outer diameter as the well at (O), and the same height as the magnet (U). This centers the magnet at the bottom of the well. In this example, a plastic tube (T) is placed inside the well, such that the closed, flat bottom of the tube presses against the top of the nut (V) and the magnet (U). The tube (T) has a height such that, when the bottom of the tube is resting on the nut (V), the open top of the tube is flush with the top of the well. The outer diameter of the tube (T) is about the same as the diameter of the well. The inner diameter of the tube (T) is greater than the outer diameter of a small tube.

A cap (S) is secured to the top of the base, such that a hole in its center aligns with the center of the tube (T). The hole in (S) is of a diameter such that a small tube may be held vertically by this hole, so that the bottom of the tube touches the inside bottom of the tube (T). The cap (S) is larger than the well. The cap (S) can serve to hold the tube (T), nut (V), and magnet (U) in place at the bottom of the well. This example had only one bead settling well. However, more bead separators can be added by the simple addition of more wells (O) in the invention base.

The automated device does not require a person to be present to actively tap the small tube containing the beads. Even bead dispersion can be automatically maintained, and since the automated device can operate continuously, even dispersion can be maintained continuously, without the repeated settling associated with having a person return to tap the tube periodically.

The automated device allows multiple tubes to undergo bead dispersion simultaneously. The automated device as described above as an example accommodates four tubes, but the design can be expanded to fit more tubes by increasing the diameter of the apparatus and adding more tube holders.

The automated device can avoid the formation of unwanted bubbles or droplets, because the invention can provide a consistent tapping motion which can cause gentle mixing in the tubes. This can improve binding conditions, and can eliminate the need for centrifuging after agitation.

The automated device can be consistent between implementations. Because the motor can run at a set rpm (e.g. 30), and the disk can have four posts, the tubes can be tapped at a consistent rate (e.g. once every half second). This can allow the frequency, duration, method, and strength of tapping to be controlled. Thus bead dispersion differences can be effectively eliminated as an unwanted experimental variable. Beads can be maintained in suspension for extended periods (e.g. overnight) without operator stress or damage to beads.

The automated device can operate within an incubator such as is sometimes used in separation experiments at a controlled temperature.

The automatic device can provide a method of settling magnetic beads. The automatic device can take significantly less time to settle beads than does gravity (the automatic device can fully settle an evenly dispersed sample in under 15 seconds). Unlike gravity, the automatic device can also fully separate magnetic beads from the surrounding fluid, since magnetic attraction clumps the beads together, driving out excess interstitial liquid. The automatic device can allow for the dispersal and settling of the beads in a single piece of equipment. The automatic device can eliminate a separate power supply for settling the beads, because it uses rare earth permanent magnets. The automatic device can accommodate a single tube, but can also potentially accommodate any number of tubes simultaneously with the simple addition of more bead separation wells to the design. Unlike magnetic separation devices that place the magnet alongside the tube, removing the tube from the automatic device can be accomplished without disturbing the separated beads, since the tube remains upright through the settling process, and can be removed vertically. The operator is not required to hold the tube while the beads settle, because a tube holder is built in to the automatic device in such a way that the tube, when inserted, can maintain a close proximity to the magnets.

The automatic device can automatically and consistently maintain even separation bead dispersion in a single or multiple tubes. Furthermore, the automatic device can provide a method for quickly and completely separating magnetic beads in one or multiple tubes.

Other alternatives include but are not limited to a device wherein the tube(s) can move while the armature(s) is stationary, or vice versa. The armature(s) can move with the tubes while the peg(s) remains stationary. The moving parts of the system can be mounted on a belt(s) or a chain(s) rather than a disk. Multiple disks can also be used. The mixing can also be achieved without the tube(s) physically striking any surface, but rather through motion designed to induce even bead dispersion within the tube(s). The mixing can be achieved using magnetic or electric fields to evenly disperse the beads inside the tube(s), or by inserting a mixing device or additive that facilitates mixing directly into the liquid within the tube(s) for the purpose of even bead dispersion. Any of the above can also be used in any combination.

Other alternatives to the bead settling portion of the automatic device can be the use of an electromagnet rather than a permanent magnet to attract the beads. Also, the bead settling magnet(s) can be incorporated into the device in such a way as to enable bead settling with the tube in the same position as used for dispersion. For example, there can be an electromagnet under each tube holder in the bead dispersion component of the device that can be activated when the period desired for dispersion was over. This can provide bead separation without moving the tube(s) to a separate area. A similar effect can be achieved using retractable permanent magnets.

Furthermore, the bead dispersion portion of the automatic device can be built without the inclusion of the bead separation component.

Example 3

In order to assess the mixing ability of the device, three sets of experiments were completed. In one experiment, magnetic beads (Charge Switch, InVitrogen, Inc.) for the nonspecific capture of nucleic acids were used to visualize the ability of the prototype device to qualitatively mix and settle magnetic beads. To measure mixing, 10 μL of beads were placed into a 0.5 mL tube and mixed for 15 seconds in the prototype device. These beads are approximately 2 μm in diameter and are composed of a magnetic core with a chemically modified surface. According to the manufacturer's instructions, the beads should be gently mixed with a pipette. The data in FIG. 12 suggests that adequate mixing can also be obtained with the prototype device presented in this work in less than 15 seconds, without risking possible contamination via the introduction of a pipette. Furthermore, FIG. 12 demonstrates that the bead settling portion of the device can create a pellet in a similar amount of time.

Example 4

In another experiment, 2-3 μm diameter bare magnetic beads were modified with reactive aldehydes, as described by Archer et al. A test solution was prepared containing an excess of amino-functionalized DNA capture probes, 600-800 bases long, in a sodium phosphate buffer for immobilization on the beads. Four samples containing identical amounts of beads and test solution were prepared in identical tubes and placed into various mixing configurations for six hours to facilitate covalent binding. The binding fraction was calculated at the end of the experiment by removing the magnetic beads and then measuring the residual amount of capture probe in solution by UV-VIS spectroscopy. This experiment was repeated four times in order to obtain statistics and ensure reproducibility. The data, averages, and standard deviations are presented in FIG. 11. These results indicate that the mixing provided by the beadwhacker demonstrated more binding (25% binding) than either static samples (no mixing—10% bound), samples where the beads were mixed by setting the tubes on top of a magnetic stir plate (10-15% bound), and samples that were placed on an elliptical mixer (10% bound). It was found that under static conditions, approximately 12 hours of reaction time is required to get binding similar to that obtained using the beadwhacker in 6 hours.

Example 5

In order to demonstrate the ability of the beadwhacker to disperse fragile species gently, another set of experiments were run. Soft beads made from Sepharose 4B (Pharmacia Biotech, Uppsala, Sweden) with a size range of 45-165 μm were suspended in TE buffer and agitated in the beadwhacker for 24 hours at room temperature. For comparison, a sample of the same beads was placed in a plastic conical vial with a screw top and a magnetic stir bar. These beads were spun on a magnetic stir plate under identical conditions for 24 hours. FIG. 13 shows representative contrast-enhanced microscopy images of the beads both before and after mixing. Even after dispersion of the unmixed beads with a pipette, the sample remained clumped (FIG. 13). After 24 hours of mixing in the beadwhacker (FIG. 13), the beads are well dispersed and similar to the unmixed beads in size. Extended mixing using a magnetic stir plate disrupted the beads to the point that they disintegrated in the tube (FIG. 13).

The data presented herein demonstrates the ability of the beadwhacker to mix and disperse micron-sized beads effectively to facilitate reactions in a short amount of time. However, an additional strength of this device is its usefulness in long-term experiments. The device can be used for uniform mixing over extended periods of time required for chemical synthesis, incubations, and other modifications in a controlled environment. Running reactions overnight or longer poses no difficulties for the beadwhacker, and with modifications it could be used for hazardous chemical reactions or potentially for operations under Bio-Safety Levels 3 or 4 conditions, where exposure to agents should be minimized. The device can be used for extended periods of time in continuous operations for laboratory experiments.

The beadwhacker can be designed for the gentle, continuous agitation of micron-sized beads and includes a magnet for separation of magnetic particles from the supernatant to expedite solid phase separations. This small, portable, inexpensive device can be built from commercially available parts and facilitates rapid, even dispersion of materials within the reaction chamber. It can be operated in a variety of different conditions, including ovens, clean rooms, fume hoods, cold rooms, and bio-safety cabinets. Finally, with appropriate modifications, the beadwhacker can be integrated into other automated systems.

The above description is that of a preferred embodiment of the invention. Various modifications and variations are possible in light of the above teachings. It is therefore to be understood that, within the scope of the appended claims, the invention may be practiced otherwise than as specifically described. Any reference to claim elements in the singular, e.g., using the articles "a," "an," "the," or "said" is not construed as limiting the element to the singular.

What is claimed is:

1. A bead agitating device comprising:

a low-RPM motor wherein said motor spins a substantially flat disk;

at least one peg attached to said disk;

wherein said at least one peg is contiguous with said substantially flat disk and is perpendicular to a flat surface of said disk;

at least one stationary semiflexible spring armature wherein said at least one peg-activates said at least one stationary semiflexible spring armature as said disk rotates; and at least one tube containing beads in a fluid positioned in a top plate wherein said at least one stationary semiflexible spring armature contacts said tube;

wherein said beads are from about sub-micron to about millimeters in diameter;

a soft foam top mounted on said top plate wherein said tube is inserted; and a secondary component wherein said secondary component comprises a holder into which said at least one tube is inserted and wherein said holder contains a magnet such that when said at least one tube is inserted a bottom of said at least one tube is in close proximity to said magnet and wherein said secondary component separates magnetic beads from a fluid;

wherein when said disk rotates, said at least one peg draws back said at least one stationary semiflexible spring armature and releases said at least one stationary semiflexible spring armature which provides a tapping motion to said at least one tube which agitates said beads within said tube;

wherein said soft foam top mounted on said top plate wherein said tube is inserted and maintained by said foam top to allow for slight motion of said at least one tube induced by said contact by said at least one stationary semiflexible spring armature;

resulting in decreased bead fragmentation and increased DNA immobilization.

2. The device of claim 1 wherein at least one tube comprises multiple tubes and wherein said beads are evenly dispersed within said tubes in less than one minute.

3. The device of claim 1 wherein said magnet causes said magnetic beads to settle at said bottom of said at least one tube and form a bead pellet.

4. The device of claim 3 wherein said bead pellet is formed in less than one minute.

5. The device of claim 3 wherein said bead pellet is formed in about 15 seconds.

6. The device of claim 1 wherein said top plate contains multiple tubes.

7. The device of claim 1 wherein said at least one spring armature comprises multiple spring armatures.

8. The device of claim 1 wherein said disk spins at a speed that results in an about 0.2-10 Hz tapping of said at least one tube.

9. The device of claim 1 wherein said disk spins at a speed that results in an about 2 Hz tapping of said at least one tube.

10. The device of claim 1 further including a magnet positioned near a bottom of said at least one tube.

* * * * *